US007658461B2

(12) United States Patent
Ito

(10) Patent No.: US 7,658,461 B2
(45) Date of Patent: Feb. 9, 2010

(54) INK-JET RECORDING APPARATUS WITH ENVIRONMENTAL TEMPERATURE BASED DRIVE-SIGNAL GENERATION

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 356 days.

(21) Appl. No.: 11/391,466

(22) Filed: Mar. 29, 2006

(65) Prior Publication Data

US 2006/0221112 A1 Oct. 5, 2006

(30) Foreign Application Priority Data

Mar. 30, 2005 (JP) ..... 2005-099615

(51) Int. Cl.
*B41J 29/38* (2006.01)
*B41J 2/045* (2006.01)

(52) U.S. Cl. ..... 347/17; 347/71

(58) Field of Classification Search ..... 347/11, 347/10, 71, 14, 17, 12, 57, 20, 44, 47, 48, 347/50, 58, 59, 62, 63, 65, 67, 68, 69, 72, 347/60

See application file for complete search history.

(56) References Cited

U.S. PATENT DOCUMENTS 5,264,865 A * 11/1993 Shimoda et al. ..... 347/11
5,361,090 A * 11/1994 Suzuki et al. ..... 347/17
5,477,246 A * 12/1995 Hirabayashi et al. ..... 347/12
5,969,730 A * 10/1999 Inose et al. ..... 347/14
5,980,013 A * 11/1999 Takahashi ..... 347/14
6,099,103 A * 8/2000 Takahashi ..... 347/11
6,109,716 A * 8/2000 Takahashi ..... 347/11
6,186,612 B1 * 2/2001 Maeda et al. ..... 347/17
6,217,141 B1 * 4/2001 Nakamura et al. ..... 347/10

(Continued)

FOREIGN PATENT DOCUMENTS

EP 0900657 A2 3/1999

(Continued)

OTHER PUBLICATIONS

European Patent Office, European Search Report for Related EP Application No. 06251461 dated Oct. 6, 2006.

*Primary Examiner*—Stephen D Meier
*Assistant Examiner*—Rene Garcia, Jr.
(74) *Attorney, Agent, or Firm*—Baker Botts L.L.P.

(57) ABSTRACT

An ink-jet recording apparatus including: (A) an ink-jet head which includes: a channel unit having a plurality of nozzles and a plurality of pressure chambers that respectively communicate with the plurality of nozzles; and an actuator unit which is disposed on the channel unit and to which drive signals are applied, thereby changing a volume of the plurality of pressure chambers; (B) a driver IC which is disposed on the ink-jet head and which includes: a drive-signal generating portion for generating the drive signals and applying the generated drive signals to the actuator unit; and a temperature sensor for detecting an environmental temperature of the actuator unit; and (C) a control device arranged to execute a low-temperature-condition control by controlling the drive-signal generating portion to generate the drive signals so as to change the volume of the plurality of pressure chambers, where the environmental temperature detected by the temperature sensor is not higher than a prescribed first temperature.

12 Claims, 14 Drawing Sheets

U.S. PATENT DOCUMENTS

| | | | | |
|---|---|---|---|---|
| 6,217,159 | B1 * | 4/2001 | Morikoshi et al. | 347/71 |
| 6,270,180 | B1 | 8/2001 | Arakawa et al. | |
| 6,354,686 | B1 * | 3/2002 | Tanaka et al. | 347/11 |
| 6,371,587 | B1 * | 4/2002 | Chang | 347/11 |
| 6,382,754 | B1 * | 5/2002 | Morikoshi et al. | 347/11 |
| 6,382,759 | B2 * | 5/2002 | Maeda et al. | 347/17 |
| 6,568,779 | B1 | 5/2003 | Pulman et al. | |
| 6,575,544 | B2 * | 6/2003 | Iriguchi | 347/11 |
| 6,612,673 | B1 * | 9/2003 | Giere et al. | 347/14 |
| 6,715,852 | B2 * | 4/2004 | Yonekubo | 347/10 |
| 7,226,141 | B2 * | 6/2007 | Asano et al. | 347/10 |
| 7,290,867 | B2 * | 11/2007 | Kobayashi et al. | 347/71 |
| 2004/0246311 | A1 * | 12/2004 | Silverbrook | 347/57 |
| 2005/0116974 | A1 * | 6/2005 | Suzuki | 347/10 |
| 2005/0190240 | A1 | 9/2005 | Takatsuka | |

FOREIGN PATENT DOCUMENTS

| | | | |
|---|---|---|---|
| JP | H08-295015 | A | 11/1996 |
| JP | 11-129496 | A | 5/1999 |
| JP | 2001-001516 | A | 1/2001 |
| JP | 2001-010110 | A | 1/2001 |
| JP | 2001-287349 | A | 10/2001 |
| JP | 2002-347223 | A | 12/2002 |

* cited by examiner

INK-JET RECORDING APPARATUS WITH ENVIRONMENTAL TEMPERATURE BASED DRIVE-SIGNAL GENERATION

The present application is based on Japanese Patent Application No. 2005-099615 filed on Mar. 30, 2005, the contents of which are incorporated herein by reference.

BACKGROUND OF THE INVENTION

1. Field of the Invention

The present invention relates in general to an ink-jet recording apparatus which performs recording by ejecting ink to a recording medium.

2. Discussion of Related Art

An ink-jet recording apparatus such as an ink-jet printer includes: an ink-jet head in which are formed a multiplicity of nozzles and which includes actuators respectively corresponding to the nozzles; and a driver IC which generates drive signals for driving the actuators. By applying, to the actuators, the drive signals generated by the driver IC, the actuators are driven, whereby ink is ejected from the nozzles for recording images and the like on a recording medium such as a recording sheet.

Representative examples of the actuator include an electrostatic actuator produced by a silicon process and a piezoelectric actuator including a piezoelectric element. Various other actuators utilizing energy transducing principle are also used. In particular, the piezoelectric actuator is widely used for the following reasons: Because the amount of deformation of the piezoelectric actuator is proportional to a voltage applied thereto, it is possible to eject ink droplets of various sizes or volumes by varying the voltage. Further, the piezoelectric actuator permits use of comparatively large sorts of inks.

The actuator, however, has a characteristic that the amount of deformation changes depending upon an environmental temperature. This characteristic is outstanding particularly in the piezoelectric actuator mentioned above. Due to this characteristic, the ejection of the ink may become unstable, causing a risk of deteriorating the print quality. In view of this, there are employed measures for stabilizing the ejection of the ink by changing the waveform and the voltage of the drive signal to be applied to the actuator, for instance. JP-A-2001-1516 discloses a technique to calculate temperature of the actuator based on the waveform of the drive signal of the actuator and correct ejection amount data in accordance with the calculated temperature. The ejection amount data is a basis for the drive signal to be applied to the actuator, and the waveform and the voltage of the drive signal are changed by correcting the ejection amount data.

SUMMARY OF THE INVENTION

Where the waveform and the voltage of the drive signal to be applied to the actuator are arranged to be variable depending upon the environmental temperature of the actuator as disclosed in the above-identified publication JP-A-2001-1516, the structure of a control means may undesirably become complicated.

It is therefore an object of the present invention to provide an ink-jet recording apparatus which prevents deterioration of print quality arising from changes in a deformation amount of an actuator due to its environmental temperature, without complicating the structure of a control means, in detail, a control device that constitutes the control means.

The above-indicated object may be attained according to a principle of the present invention, which provides an ink-jet recording apparatus comprising: (A) an ink-jet head which includes: a channel unit having a plurality of nozzles and a plurality of pressure chambers that respectively communicate with the plurality of nozzles; and an actuator unit which is disposed on the channel unit and to which drive signals are applied, thereby changing a volume of the plurality of pressure chambers; (B) a driver IC which is disposed on the ink-jet head and which includes: a drive-signal generating portion for generating the drive signals and applying the generated drive signals to the actuator unit; and a temperature sensor for detecting an environmental temperature of the actuator unit; and (C) a control device arranged to execute a low-temperature-condition control by controlling the drive-signal generating portion to generate the drive signals so as to change the volume of the plurality of pressure chambers, where the environmental temperature detected by the temperature sensor is not higher than a prescribed first temperature.

In the ink-jet recording apparatus constructed as described above wherein the driver IC is disposed on the ink-jet head and the driver IC is equipped with the temperature sensor, the temperature detected by the temperature sensor is substantially equal to an environmental temperature of the actuator unit. The environmental temperature means the temperature of the actuator unit per se or the temperature of the proximity of the actuator unit. Accordingly, at the substantially same time when the environmental temperature of the actuator unit becomes equal to or lower than the prescribed first temperature, the control device can judge that the environmental temperature of the actuator unit is not higher than the prescribed first temperature and can execute the low-temperature-condition control without delay. More specifically explained, when the environmental temperature of the actuator unit is judged to be not higher than the prescribed first temperature, the drive-signal generating portion of the driver IC can generate drive signals. The generated drive signals are applied to the actuator unit, so that the actuator unit is driven and generate heat.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
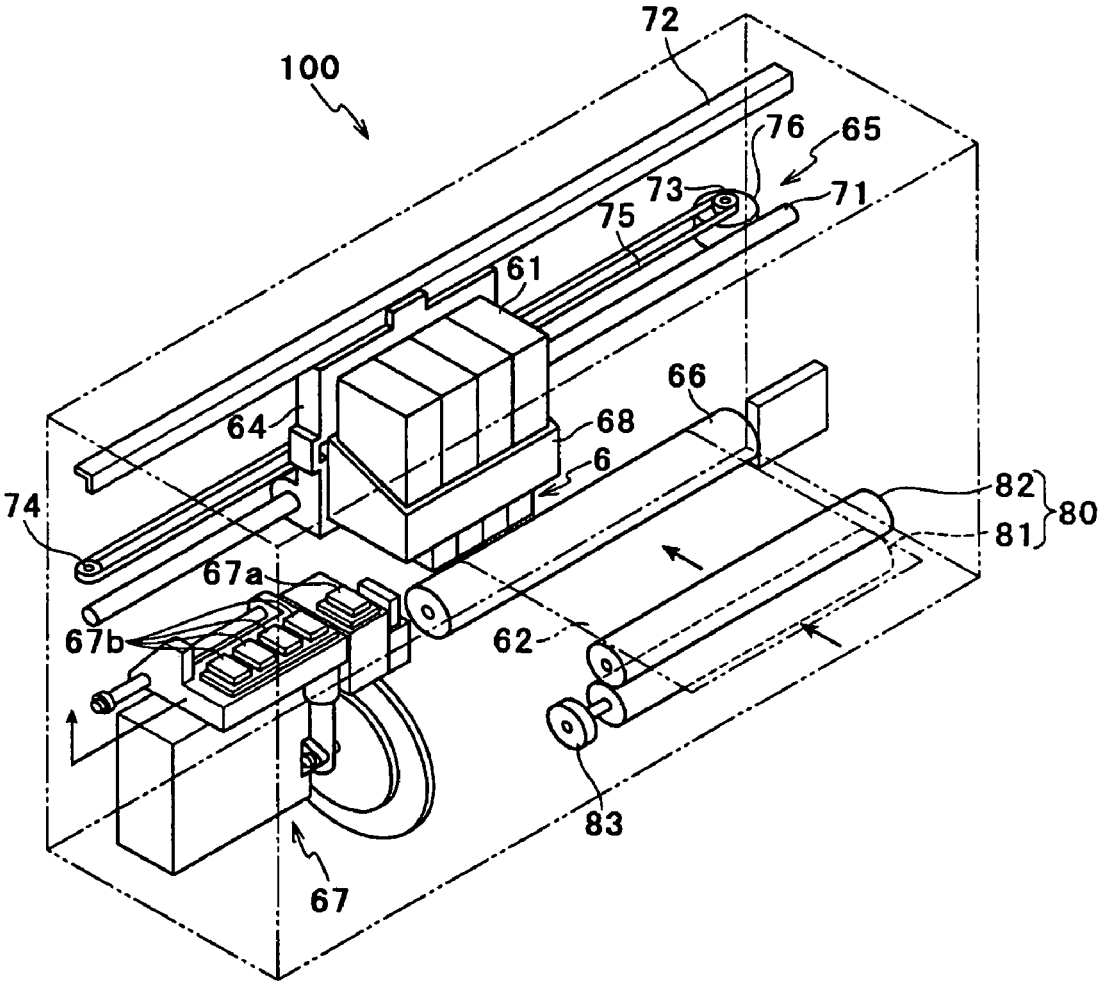
FIG. 1 is a perspective view of an ink-jet printer according to one embodiment of the present invention.

By referring to the drawings, there will be described preferred embodiments of the present invention. Here, there will be explained an ink-jet printer as an ink-jet recording apparatus according to the present invention.

Referring first to FIG. 1, there will be described an overall construction of an ink-jet printer according to one embodiment of the invention.

The ink-jet printer according to the present embodiment is a color printer 100 including: a box-like frame 68 opening upward; four ink-jet heads 6 fixed to the bottom surface of the frame 68; and four ink cartridges 61 detachably attached to the frame 68 so as to correspond to the four ink-jet heads 6, respectively. The four ink cartridges 61 respectively store inks of mutually different four colors, i.e., magenta, yellow, cyan and black.

A carriage 64 supporting the frame 68 is slidably supported by a guide shaft 71 and a guide plate 72 which are parallel to each other, and is reciprocated by a carriage moving mechanism 65 along the guide shaft 71 and the guide plate 72.

The carriage moving mechanism 65 as a carriage moving device includes: two pulleys 73, 74 respectively disposed in the vicinity of opposite end portions of the guide shaft 71; an endless belt 75 wound around the two pulleys 73, 74; and a motor 76 for driving one 73 of the two pulleys 73, 74. The carriage 64 is fixed to the endless belt 75. When the endless belt 75 is rotated by rotating the pulley 73 forward or backward by the motor 76, the carriage 64 fixed to the endless belt 75 is reciprocated with the frame 68, together with the ink-jet heads 6 and the ink cartridges 61 attached to the frame 68. Thus, the carriage 64 is selectively placed at: a record position where an ink ejection surface (lower surface) of each ink-jet head 6 in which are formed nozzles 35 (FIGS. 2-6) faces a recording sheet 62 as a recording medium fed by a roller pair 80 and so on described below; and a retracted position where the ink ejection surface cannot face the recording sheet 62. A head moving device is constituted by including the carriage 64 and the carriage moving mechanism 65.

The recording sheet 62 is fed from a sheet-supply cassette not shown which is disposed at one side of the ink-jet printer 100 and is introduced into a space present between the ink-jet heads 6 and a platen roller 66 while being held by and between the roller pair 80. The roller pair 80 consists of a drive roller 81 rotatably driven by a sheet-feed motor 83 and a driven roller 82 rotated by the drive roller 81. The platen roller 66 is provided such that the platen roller 66 extends parallel to the guide shaft 71 and the guide plate 72 and such that the platen roller 66 is disposed under the ink-jet heads 6 so as to face the same 6. Like the drive roller 81, the platen roller 66 is rotatably driven by a motor not shown and feeds the recording sheet 62 toward a downstream side in a sheet-feed direction in which the recording sheet 62 is fed. After the ink-jet heads 6 eject droplets of the inks from the nozzles 35 toward the recording sheet 62 and thereby record images, characters and the like on the recording sheet 62, the sheet 62 is discharged out of the printer 100.

A purge mechanism 67 is disposed at one side of the platen roller 66, that is, at the above-indicated retracted position of the carriage 64. The purge mechanism 67 includes a purge cap 67*a* and four protecting caps 67*b*. The purge cap 67*a* is arranged to cover a multiplicity of the nozzles 35 which are formed in the lower surface of each ink-jet head 6 for removing, by suction, a poor-quality ink which remains in each ink-jet head 6 and which contains air bubbles, dusts and the like. The four protecting caps 67*b* are arranged to be attached to respective lower ends of the four ink-jet heads 6 when the carriage 64 is placed at the retracted position by the carriage moving mechanism 65, for preventing drying of the inks around the nozzles 35.

Figure 2:
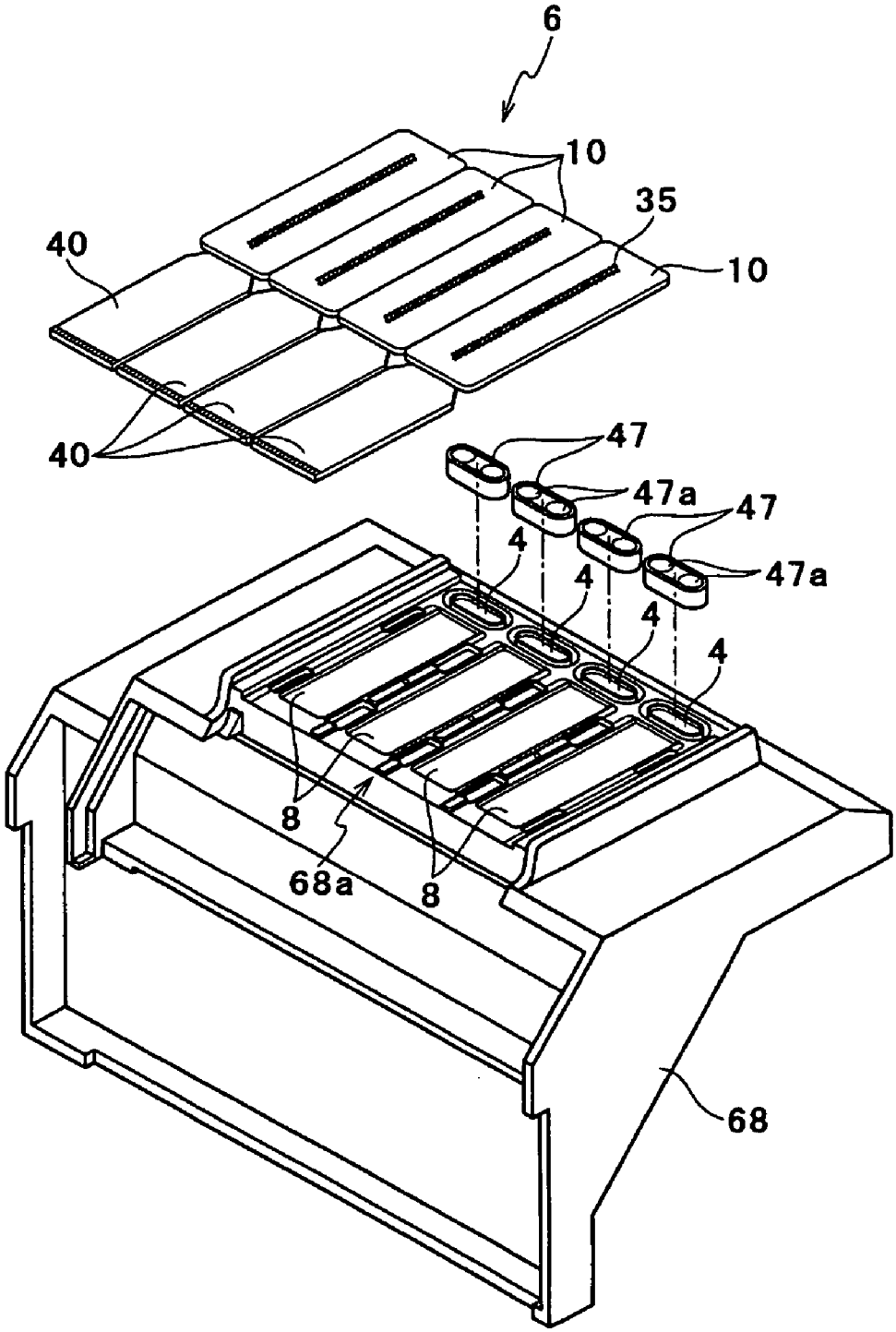
FIG. 2 is an exploded perspective view showing a frame and ink-jet heads of the ink-jet printer of FIG. 1 upside down.

Referring next to FIG. 2, there will be explained the frame 68 to which the ink-jet heads 6 are fixed. In FIG. 2, the frame 68 and the ink-jet heads 6 are shown upside down.

The frame 68 has four ink supply passages 4 formed through its bottom plate 68*a* so as to respectively correspond to four ink outlets, not shown, of the respective four ink cartridges 61 shown in FIG. 1. Four joint members 47 each made of a rubber, for instance, are attached to the lower surface of the bottom plate 68*a* of the frame 68 to which the ink-jet heads 6 are fixed, such that the joint members 47 correspond to the respective ink supply passages 4. Each joint member 47 has two openings 47*a* that communicate with respective two ink supply inlets 39*a* shown in FIGS. 3 and 4 formed on an upper surface of a channel unit 10 of a corresponding one of the ink-jet heads 6. The ink-jet heads 6 are fixed to the frame 68 such that the respective channel units 10 of the ink-jet heads 6 come into close contact, at respective upper surfaces thereof, with the corresponding joint members 47. The frame 68 has, in the lower surface of the bottom plate 68*a*, four recessed portions 8 for receiving therein the four ink-jet heads 6, respectively. The ink-jet heads 6 are fixed to the respective recessed portions 8 by an adhesive of UV-curable type, for instance.

Figure 3:
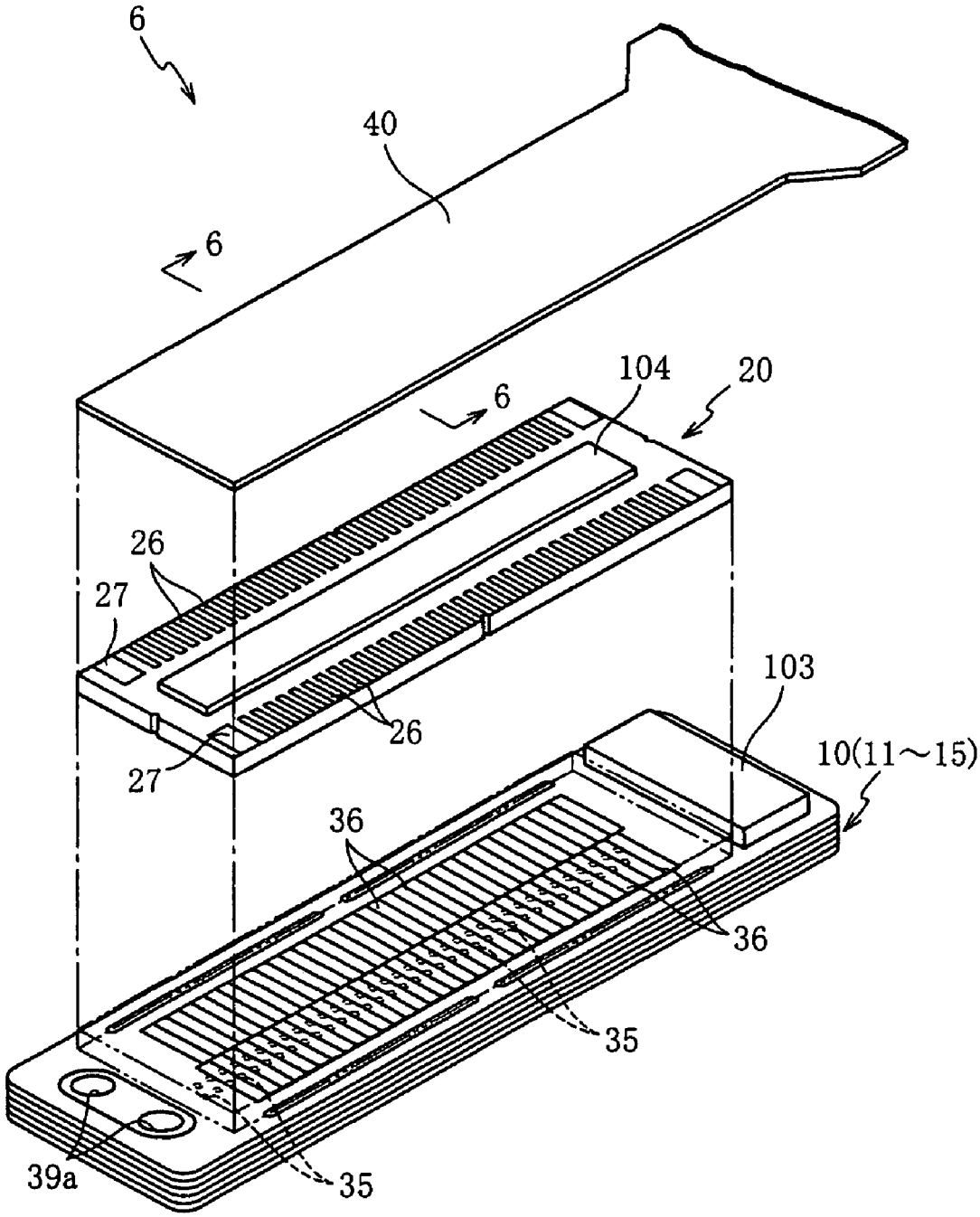
FIG. 3 is an exploded perspective view of one of the ink-jet heads of FIG. 2.

FIG. 3 shows one of the ink-jet heads 6 which are identical in construction. Each ink-jet head 6 includes the channel unit 10, an actuator unit 20 and a flexible flat cable 40 which are stacked on each other. Namely, the actuator unit 20 is bonded to the upper surface of the channel unit 10, and the flexible flat cable 40 is bonded to an upper surface of the actuator unit 20. Hereinafter, the explanation will be made with respect to one ink-jet head 6.

The actuator unit 20 is disposed at a substantially central portion of the upper surface of the channel unit 10. The above-described two ink supply inlets 39*a* that respectively communicate with the two openings 47*a* of the corresponding joint member 47 are formed in the upper surface of the channel unit 10 at a location in the vicinity of one longitudinal end portion of the channel unit 10 and adjacent to the portion at which the actuator unit 20 is disposed. A driver IC 103 for applying drive signals to the actuator unit 20 is fixed to the channel unit 10 at a location in the vicinity of another longitudinal end portion of the channel unit 10 and adjacent to the portion at which the actuator unit 20 is disposed.

On the upper surface of the actuator unit 20, there is fixed a Peltier element 104 as a cooling device which cools the actuator unit 20. The flexible flat cable 40 is bonded not only to the actuator unit 20 but also to the Peltier element 104 and the driver IC 103, whereby the flexible flat cable 40 electrically connects the actuator unit 20, the Peltier element 104 and the driver IC 103 to a control portion 101 described below.

By reference to FIGS. 4-6, the channel unit 10 of the ink-jet head 6 will be explained. The channel unit 10 has a stacked structure in which six thin metal plates, i.e., a nozzle plate 11, a damper plate 12, two (first and second) manifold plates 13X, 13Y, a spacer plate 14 and a base plate 15 are stacked on and bonded to each other.

Figure 4:
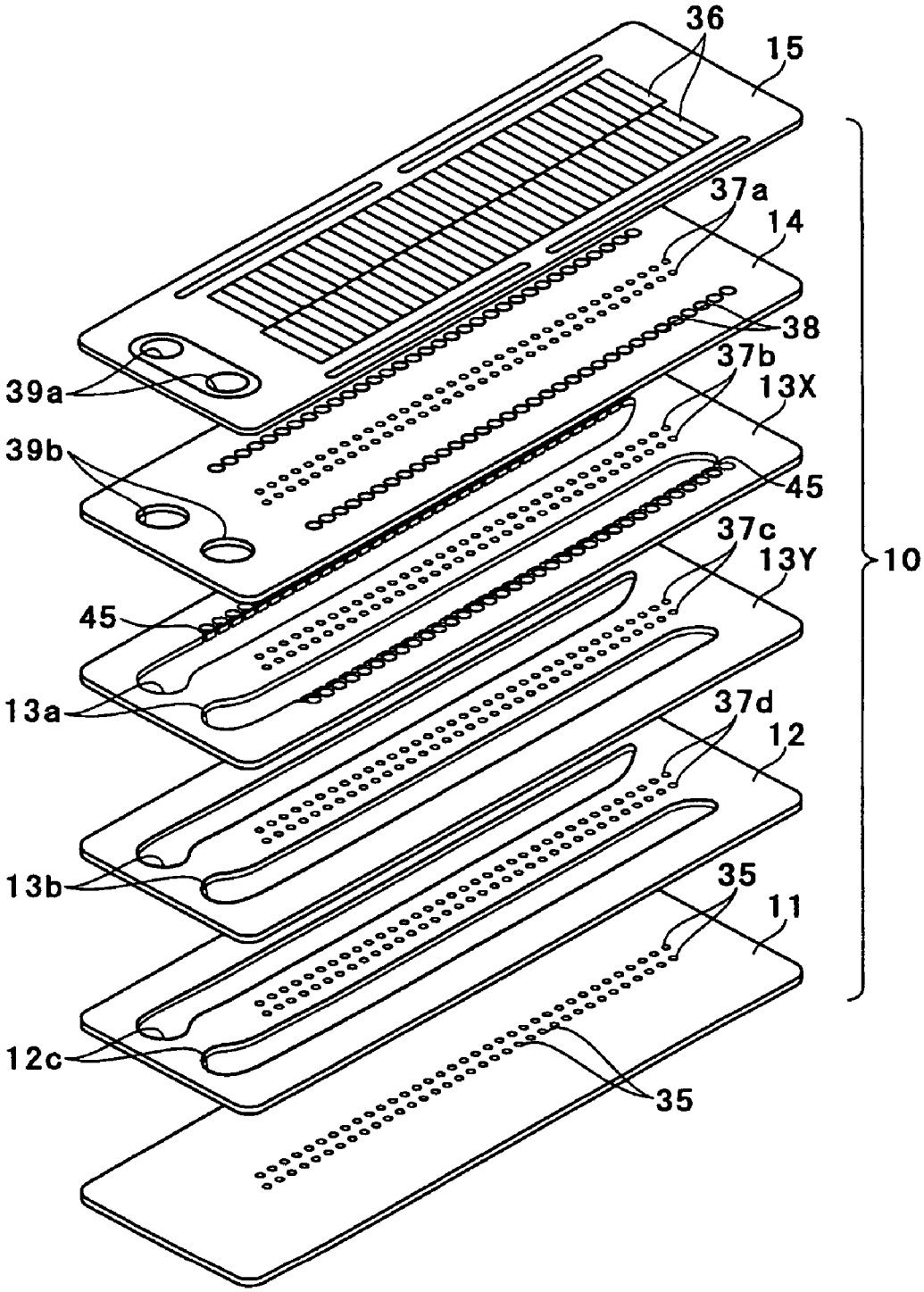
FIG. 4 is an exploded perspective view of a channel unit of the ink-jet head of FIG. 3.
Figure 5:
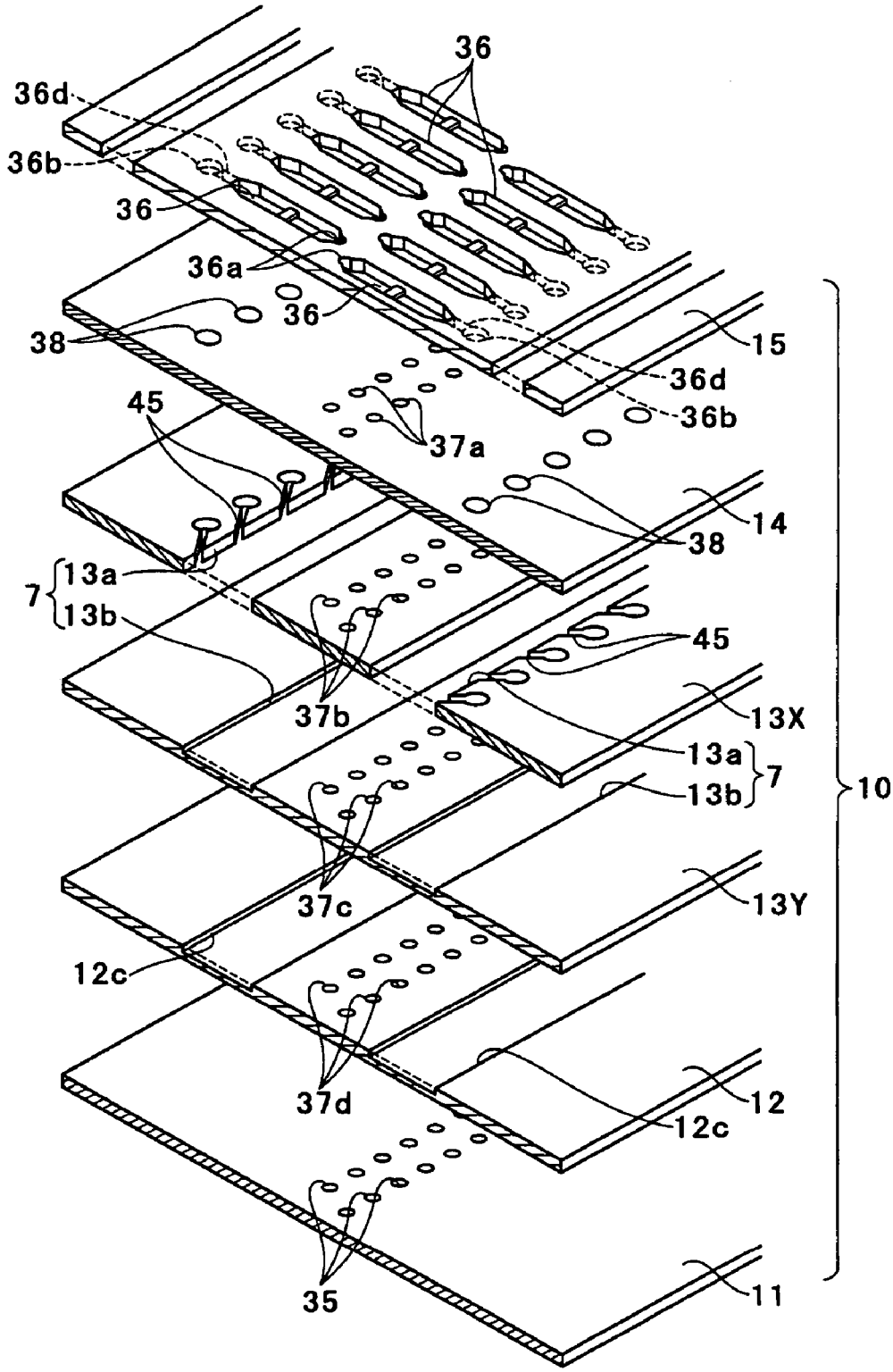
FIG. 5 is an enlarged perspective view of a portion of the channel unit of FIG. 4.

As shown in FIGS. 4 and 5, the nozzle plate 11 which is the lowermost plate in the channel unit 10 has a large number of nozzles 35 arranged in two rows in a zigzag or staggered fashion along a longitudinal direction of the nozzle plate 11. The base plate 15 which is the uppermost plate in the channel unit 10 has a large number of pressure chambers 36 arranged in two rows in a zigzag or staggered fashion along a longitudinal direction of the base plate 15. Each pressure chamber 36 has a generally rectangular shape in plan view and is elongate in a direction perpendicular to the longitudinal direction of the base plate 15.

As shown in FIG. 5, the base plate 15 has, in its lower surface, recessed portions 36*b* and restrictor portions 36*d*. Each of the restrictor portions 36*d* connects one longitudinal end portion 36*a* of a corresponding one of the pressure chambers 36 and a corresponding one of the recessed portions 36*b* to each other. Other longitudinal end portions of the respective pressure chambers 36 communicate with the corresponding nozzles 35 via respective through-holes 37*a* formed in the spacer plate 14, respective through-holes 37*b* formed in the first manifold plate 13X, respective through-holes 37*c* formed in the second manifold plate 13Y and respective through-holes 37*d* formed in the damper plate 12, which through-holes 37*a*-37*d* are arranged in a zigzag fashion.

As shown in FIG. 4, the spacer plate 14 has two ink supply inlets 39*b* formed so as to correspond to the respective two ink supply inlets 39*a* of the base plate 15. The two ink supply inlets 39*a* of the base plate 15 and the two ink supply inlets 39*b* of the spacer plate 14 correspond to longitudinal ends of respective two half ink chambers 13*a* formed in the first manifold plate 13X. The half ink chambers 13*a*, 13*b* will be explained later. The ink supplied from the ink outlet, not shown, of the ink cartridge 61 flows into two common ink chambers 7 shown in FIG. 6, via the ink supply inlets 39*a* of the base plate 15 and the ink supply inlets 39*b* of the spacer plate 14. The spacer plate 14 further has a large number of communication holes 38 arranged in two rows extending in a longitudinal direction of the spacer plate 14 with the two rows of the through-holes 37*a* interposed therebetween.

As shown in FIG. 4, the upper one of the two manifold plates 13X, 13Y, i.e., the first manifold plate 13X has the above-described two half ink chambers 13*a* each of which has an elongate shape extending in the longitudinal direction of the plate 13X and which are formed so as to sandwich the two rows of the through-holes 37*b* therebetween. The lower one of the two manifold plates 13X, 13Y, i.e., the second manifold plate 13Y has the above-described half ink chambers 13*b* which substantially align with the respective two half ink chambers 13*a* in plan view and which are substantially identical in configuration and size with the half ink chambers 13*a*. Each half ink chamber 13*a* of the first manifold plate 13X is formed through the thickness of the plate 13X while each half ink chamber 13*b* of the second manifold plate 13Y is recessed in an upper surface of the plate 13Y so as to open toward the first manifold plate 13X. The two manifolds plates 13X, 13Y are stacked on each other and the half ink chambers 13*a*, 13*b* align with each other in plan view, thereby defining the two common ink chambers 7 shown in FIG. 6 which are respectively located on opposite sides of the rows of the through-holes 37*a*-37*d*.

In one side wall of each common chamber 7, there are formed a large number of connection portions 45 arranged in a longitudinal direction of the common chamber 7. As shown in FIG. 6, the connection portions 45 correspond to the respective communication holes 38 formed in the spacer plate 14 and the respective recessed portions 36*b* formed in the base plate 15. The ink in the common chambers 7 is supplied to the corresponding pressure chambers 36 via the corresponding connection portions 45, communication holes 38, recessed portions 36 and restrictor portions 36*d*.

As shown in FIG. 4, the damper plate 12 has two damping grooves 12*c* which substantially align, in plan view, with the respective half ink chambers 13*a* of the first manifold plate 13X and the respective half ink chambers 13*b* of the second manifold plate 13Y and which are identical in configuration and size with the half ink chambers 13*a*, 13*b*. Like the half ink chambers 13*b*, the damping grooves 12*c* are recessed in an upper surface of the damper plate 12 so as to open upward, as shown in FIG. 5.

Thus, in the channel unit 10, there are formed individual ink flow passages (hereinafter referred to as "channels" where appropriate) from the common ink chambers 7 to the nozzles 35 via the connection portions 45, the communication holes 38, the recessed portions 36*b*, the restrictor portions 36*d*, the pressure chambers 36 and the through-holes 37*a*, 37*b*, 37*c*, 37*d*. In the present embodiment, the number of the channels formed in the channel unit 10 is 304.

Figure 6:
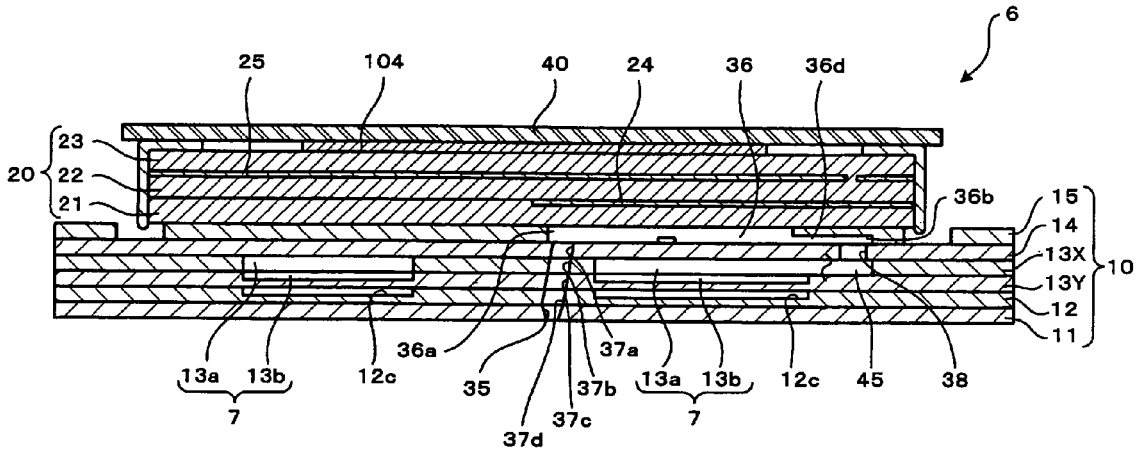
FIG. 6 is a cross sectional view taken along line 6-6 of FIG. 3.
Figure 7:
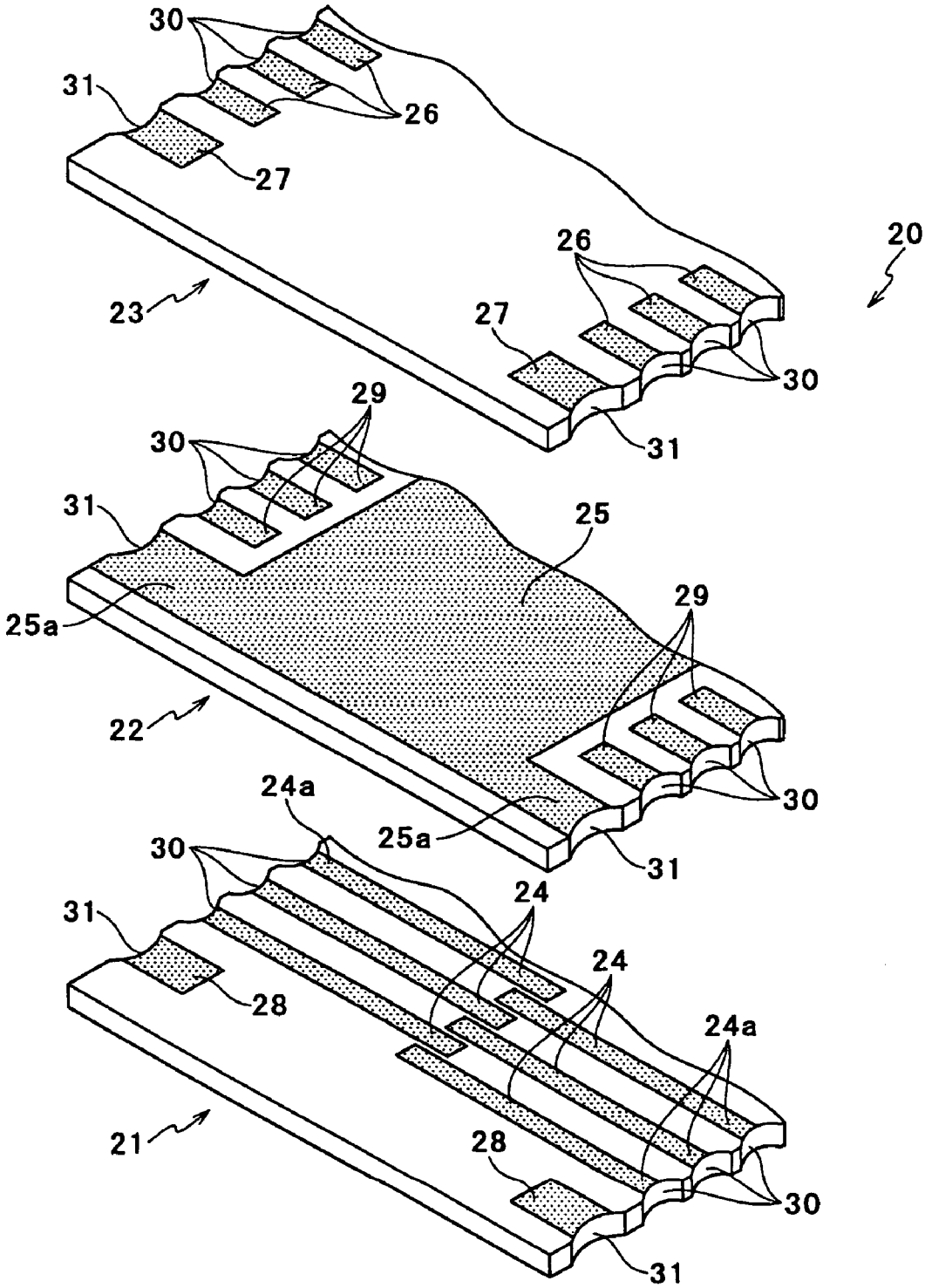
FIG. 7 is an enlarged perspective view showing a portion of an actuator unit of the ink-jet head of FIG. 3.

Referring next to FIGS. 6 and 7, the structure of the actuator unit 20 will be explained. The actuator unit 20 has a stacked structure in which first and second piezoelectric sheets 21, 22 and an electrically insulating sheet 23 are superposed on each other. In the actuator unit 20 shown in FIG. 6, there are formed, on an upper surface of the first piezoelectric sheet 21, individual electrodes (drive electrodes) 24 respectively corresponding to the pressure chambers 36 of the channel unit 10 while there are formed, on an upper surface of the second piezoelectric sheet 22, a common electrode 25 that is common to all of the pressure chambers 36. In the thus constructed actuator unit 20, portions of the second piezoelectric sheet 22 which are sandwiched by and between the corresponding individual electrodes 24 and the common electrode 25 function as pressure-generating portions that respectively correspond to the pressure chambers 36.

As shown in FIG. 7, the common electrode 25 has two extended portions 25*a* located in the vicinity of one longitudinal end of the second piezoelectric sheet 22 so as to extend in its widthwise opposite directions. The extended portions 25*a* are exposed in corresponding long side surfaces of the second piezoelectric sheet 22. The individual electrodes 24 have respective outer end portions 24*a* which are exposed in corresponding long side surfaces of the first piezoelectric sheet 21.

At widthwise opposite end portions of an upper surface of the insulating sheet 23, there are respectively formed surface electrodes 27 corresponding to the respective extended portions 25*a* of the common electrode 25 and surface electrodes 26 corresponding to the respective individual electrodes 24. Like the outer end portions 24*a* of the respective individual electrodes 24 and the extended portions 25*a* of the common electrode 25, outer end portions of the respective surface electrodes 26, 27 are exposed in corresponding long side surfaces of the insulating sheet 23.

The two piezoelectric sheets 21, 22 and the insulating sheet 23 respectively have, on their two long side surfaces, first grooves 30 which correspond to the respective outer end portions 24*a* of the individual electrodes 24 and second grooves 31 which correspond to the respective extended portions 25*a* of the common electrode 25. The first and second grooves 30, 31 extend in the direction of stacking of the sheets 21, 22, 23. Within each of the first grooves 30, there is formed an external electrode not shown, for electrically connecting a corresponding one of the individual electrodes 24 and a corresponding one of the surface electrodes 26 to each other. Within each of the second grooves 31, there is formed an external electrode not shown, for electrically connecting a corresponding one of the extended portions 25*a* of the common electrode 25 to a corresponding one of the surface electrodes 27. In FIG. 7, reference numerals 28, 29 denote dummy electrodes.

With the actuator unit 20 positioned relative to the channel unit 10 such that the individual electrodes 24 correspond to the respective pressure chambers 36 of the channel unit 10, the actuator unit 20 is bonded to the channel unit 10. On the upper surface of the actuator unit 20, the flexible flat cable 40 is bonded so as to be electrically connected to the surface electrodes 26, 27.

Next, there will be explained an operation of the actuator unit 20. Each of the pressure-generating portions of the actuator unit 20 deforms depending upon a drive signal to be applied from a driver IC 103 which will be described, thereby changing a volume of the corresponding pressure chamber 36.

When an electric voltage is applied selectively between the individual electrodes 24 and the common electrode 25, portions of the second piezoelectric sheet 22 which correspond to the voltage-applied individual electrodes 24 undergo strain in the direction of stacking of the sheets 21, 22, 23 owing to a piezoelectric effect and the piezoelectric sheet 22 deforms convexly toward the pressure chambers 36, so that the volume of the pressure chambers 36 is decreased.

There will be next explained an electric structure of the present ink-jet printer 100 by reference to FIGS. 8-11.

Figure 8:
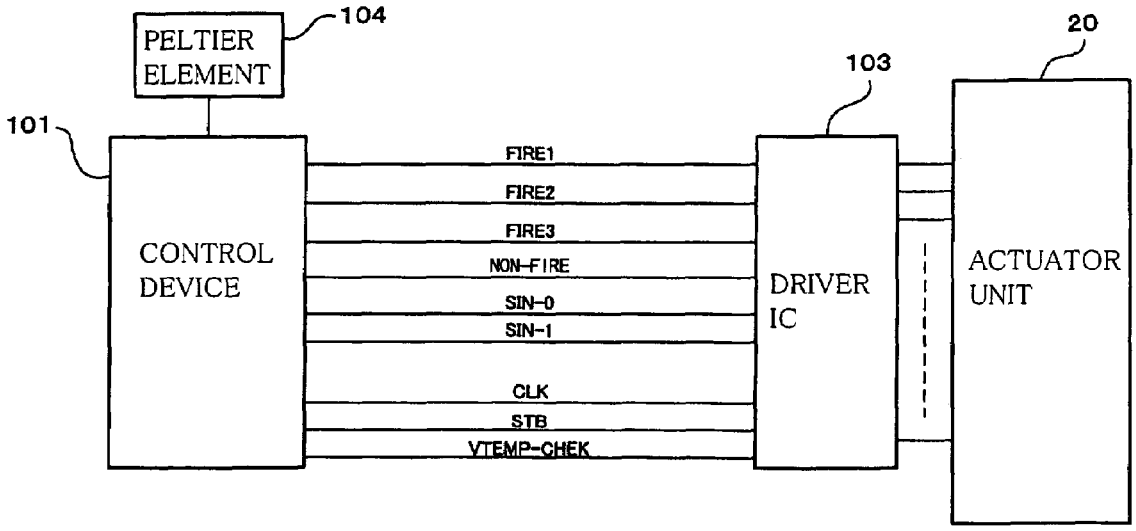
FIG. 8 is a block diagram schematically showing an electric connection among a control portion, a driver IC, the actuator unit and a Peltier element that is fixed on an upper surface of the actuator unit, of the ink-jet printer of FIG. 1.

As shown in FIG. 8, the ink-jet printer 100 has a control portion 101 as a control device that is electrically connected to the driver IC 103 via the flexible flat cable 40. The driver IC 103 is electrically connected to the actuator unit 20. The control portion 101 is electrically connected also to the Peltier element 104. In the present ink-jet printer 100, the control portion 101 is connected to the four driver ICs 103 and the four actuator units 20 of the respective four ink jet heads 6. It is, however, noted that FIGS. 8 and 9 show only one driver IC 103 and only one actuator unit 20 and that the following explanation is made with respect to the driver IC 103 and the actuator unit 20 of one ink-jet head 20.

Figure 9:
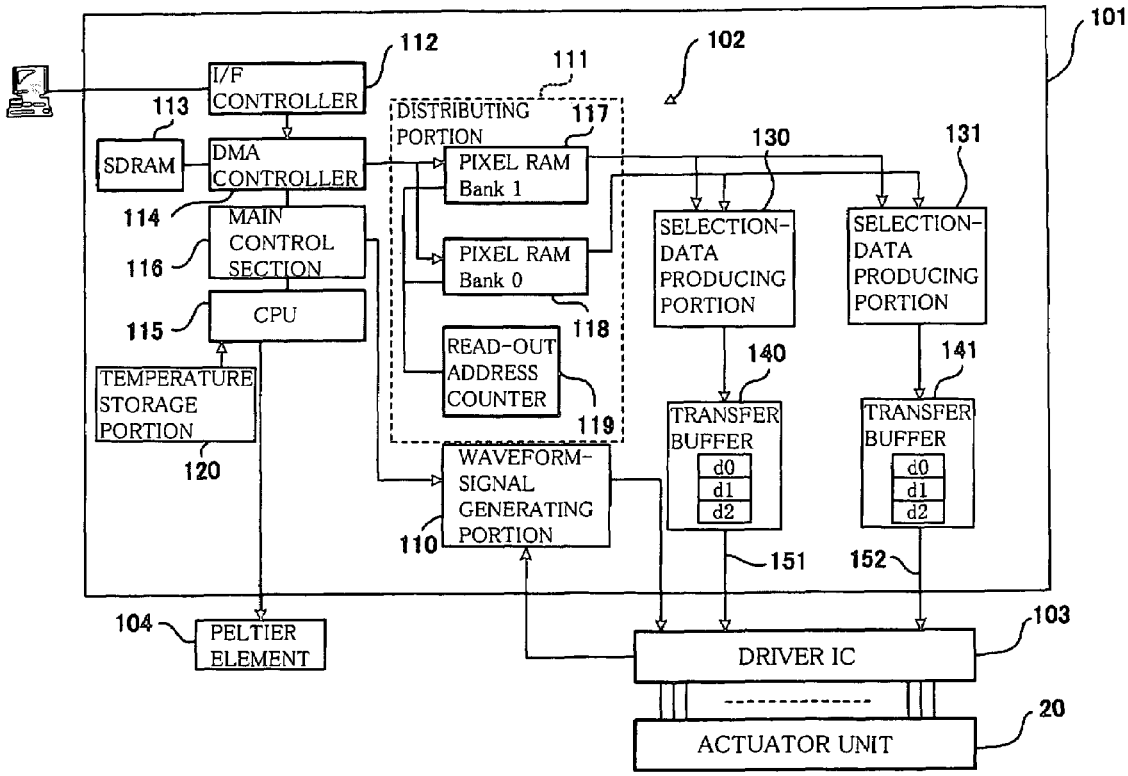
FIG. 9 is a block diagram showing details of the control portion.

As shown in FIG. 9, pixel data relating to an image to be recorded is inputted from an external device such as a personal computer to the control portion 101 via an I/F (interface) controller 112. The pixel data is stored in an SDRAM (Synchronous Direct Random Access Memory) 113 via a DMA (Direct Memory Access) controller 114. The DMA controller 114 is controlled by a MAIN control section 116 connected to a CPU 115.

The control portion 101 has a main circuit 102 including: a waveform-signal generating portion 110; a distributing portion 111; two selection-data producing portions 130, 131; and two transfer buffers 140, 141. The waveform-signal generating portion 110 generates three sorts of waveform signals FIRE1, FIRE2, FIRE3 for performing tone printing and a waveform signal non-FIRE for generating non-ejection signals which will be described, under control of the MAIN control section 116, and transmits the generated waveform signals to the driver IC 103. The distributing portion 111 distributes the pixel data stored in the SDRAM 113 into two groups. The two groups of the pixel data are transferred to the selection-data producing portions 130, 131, respectively. The selection-data producing portions 130, 131 respectively produce selection data which correspond to any of four signals including those three waveform signals FIRE1, FIRE2, FIRE3 and an ejection-free signal VDD1 shown in FIG. 11, on the basis of the two groups of the pixel data distributed from the distributing portion 111. That is, when the pixel data is one that represents a small pixel, selection data corresponding to FIRE1 is produced. When the pixel data is one that represents a medium-size pixel, selection data corresponding to FIRE2 is produced. When the pixel data is one that represents a large pixel, selection data corresponding to FIRE 3 is produced. When the pixel data is one that represents no pixel (e.g., ink should not be ejected), selection data corresponding to VDD1 is produced except in the temperature condition described as follows. Where the pixel data in the selection-data producing portions 130, 131 is the one that represents no pixel when the temperature detected by a temperature sensor 181 which will be explained is not higher than the prescribed lowest temperature value (e.g., 20° C. in the present embodiment) or where no pixel data is stored in the selection-data producing portions 130, 131 when the temperature is not higher than the lowest temperature value, the selection-data producing portions 130, 131 produce selection data which corresponds to the waveform signal non-FIRE. Accordingly, the selection-data producing portions 130, 131 respectively produce 3-bit selection data which corresponds to any of the four waveform signals FIRE1, FIRE2, FIRE3, non-FIRE and the ejection-free signal VDD1. These five signals are hereinafter referred to as "waveform signals". The selection data is for indicating, for each channel, which one of the five waveform signals is to be used in one record cycle. The selection data is transferred to the driver IC 103 from the transfer buffers 140, 141 via signal lines 151, 152, respectively.

Figure 10:
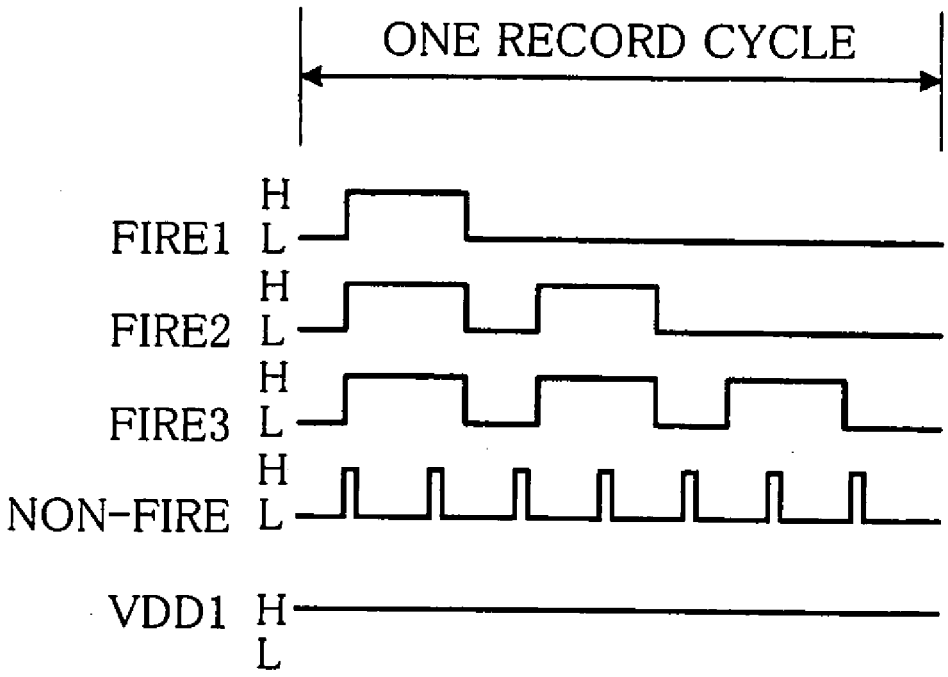
FIG. 10 is a view for explaining waveform signals generated by a waveform-signal generating portion of the control portion of FIG. 9.

The waveform signals to be transferred to the driver IC 103 will be explained in detail. As shown in FIG. 10, each of the three waveform signals FIRE1, FIRE2, FIRE3 generated by the waveform-signal generating portion 110 is a pulse train signal in which an electric potential becomes a high level one or plural times. The three waveform signals FIRE1-FIRE3 have mutually different numbers of times the electric potential becomes the high level. Namely, the waveform signals FIRE1-FIRE3 have mutually different numbers of times of ink ejection from each nozzle 35 for tone control, in accordance with the mutually different numbers of times the electric potential becomes the high level. More specifically described, in one record cycle, the ink is ejected once by the signal FIRE1, twice by the signal FIRE2, and three times by the signal FIRE3, whereby the amount of the ink to be ejected in one record cycle is varied depending upon the signals. As shown in FIG. 10, the signal non-FIRE is also a pulse train signal but is not for ejecting the ink. The ejection-free signal VDD1 shown in FIG. 11 has a constant electric potential kept at the same level as the high level of the above-indicated four waveform signals FIRE1-FIRE3 and non-FIRE. Accordingly, the waveform signals to be transmitted to the driver IC 103 include the ejection-free signal VDD1 and the four waveform signals FIRE1-FIRE3 and non-FIRE generated by the waveform-signal generating portion 110. The amount of the ink to be ejected is zero for VDD1, small for FIRE1, medium for FIRE2, and large for FIRE3. The amount of the ink to be ejected is also zero for non-FIRE. However, the volume of the pressure chambers vary, whereby the ink vibrates in the nozzles.

Hereinafter, there will be explained in detail transfer of the pixel data in the control portion 101.

In the SDRAM 113, the pixel data for one scanning movement for each channel is stored in order. The pixel data is constituted by two bits. Each of the above-indicated four sorts of the ink ejection amount in one record cycle is represented by a combination of the bit values.

The distributing portion 111 includes two pixel RAMs (Bank1, Bank0) 117, 118, and a read-out address counter 119. At the same time when pixel data of eight dots for each channel is transferred from the SDRAM 113 and stored in one of the two pixel RAMs 117, 118, another pixel data of eight dot is read out by the other of the two pixel RAMs 117, 118 from an address designated by the read-out address counter 119. Thus, the pixel data is distributed by the distributing portion 111 into two groups.

The two groups of the pixel data distributed by the distributing portion 111 are transferred to the selection-data producing portions 130, 131, respectively. The selection-data producing portions 130, 131 include respective memories in which is stored the respective pixel data of eight dots belonging to the respective two groups distributed by the distributing portion 111. Each of the selection-data producing portions 130, 131 produces selection data based on the corresponding pixel data and based on whether or not the temperature detected by the temperature sensor 181 is not higher than the prescribed lowest temperature value (e.g., 20° C. in the present embodiment).

There will be next explained a structure of the driver IC 103.

Figure 11:
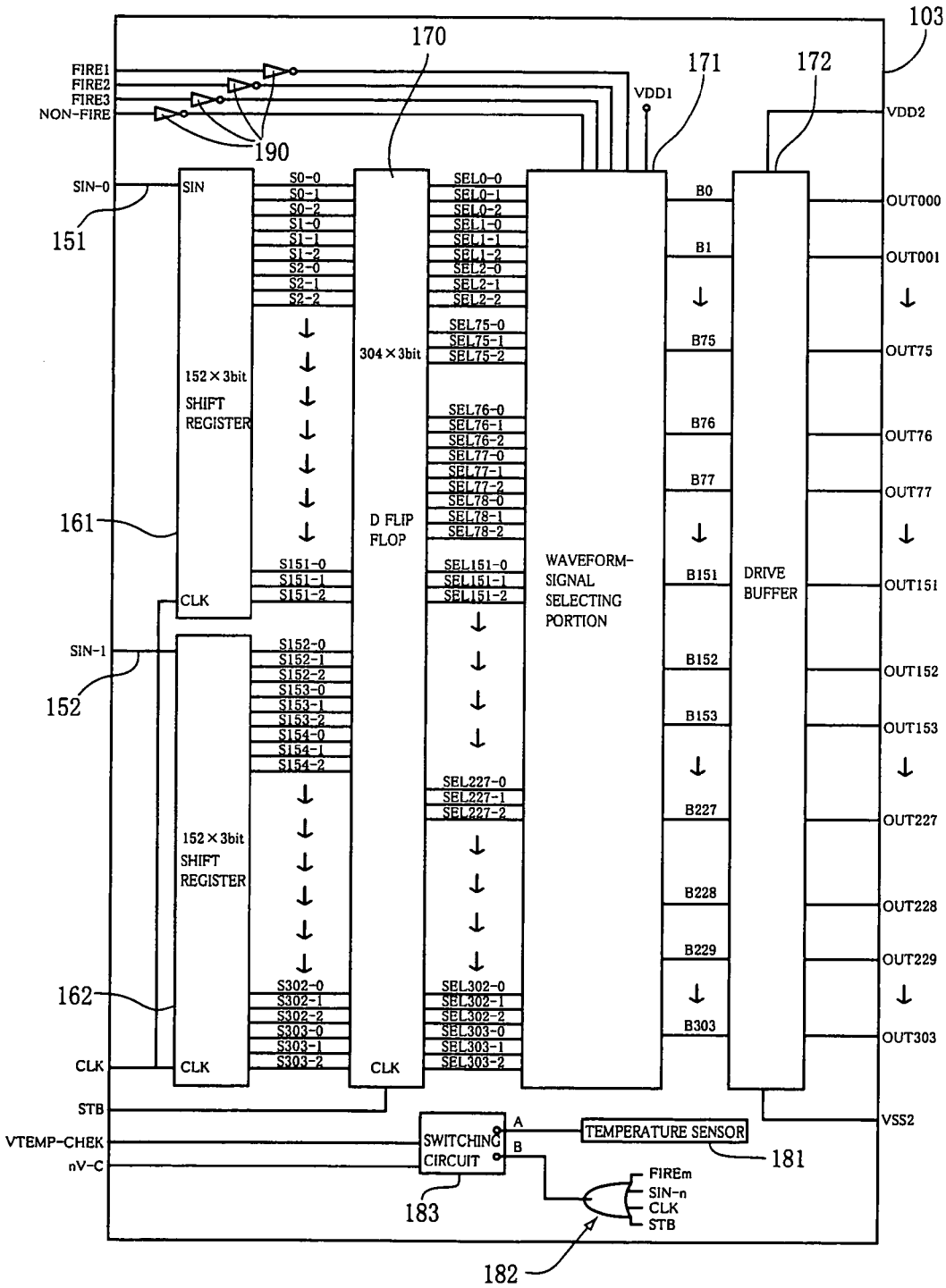
FIG. 11 is a block diagram of the driver IC of FIG. 8.

As shown in FIG. 11, the driver IC 103 includes two shift registers 161, 162 each as a serial-parallel converter, a D flip flop 170 as a latch circuit, a waveform-signal selecting portion 171 constituted by multiplexers, and a drive buffer 172.

To each of the shift registers 161, 162, selection data for 152 channels is serially inputted from a corresponding one of the transfer buffers 140, 141, via a corresponding one of the signal lines 151, 152, at a timing when a transfer clock CLK supplied form the control portion 101 rises. The shift registers 161, 162 conduct serial-parallel conversion of the inputted selection data and output, to the D flip flop 170, parallel signals Sx-0, Sx-1 and Sx-2 corresponding to the respective channels, wherein x represents a channel number and is an integer of 0-303. It is noted that "x" appearing in the following explanation represents the same.

The D flip flop 170 outputs the parallel signals Sx-0, Sx-1 and Sx-2 as selection signals SELx-0, SELx-1 and SELx-2 to the waveform-signal selecting portion 171 at a timing when a strobe signal STB transmitted from the control portion 101 rises.

To the waveform-signal selecting portion 171, the selection signals SELx-0, SELx-1 and SELx-2 and the five sorts of waveform signals FIRE1-FIRE3, non-FIRE, VDD1 are inputted. The four waveform signals FIRE1-FIRE3 and non-FIRE are inputted to the waveform-signal selecting portion 171 such that the high level and the low level thereof are inverted by respective inverting circuits 190. The signal VDD1 is inputted to the waveform-signal selecting portion 171 without being inverted. The waveform-signal selecting portion 171 selects, for each channel, one signal from among the five waveform signals FIRE1-FIRE3, non-FIRE and VDD1 on the basis of the corresponding selection signal SELx-0, SELx-1 and SELx-2, and outputs the selected waveform signal Bx to the drive buffer 172.

The drive buffer 172 amplifies the waveform signals Bx supplied from the waveform-signal selecting portion 171 and thereby produces drive signals OUTx each having a suitable voltage. The drive signals OUTx are applied to the respective pressure-generating portions of the actuator unit 20 that correspond to the respective channels.

The drive buffer 172 produces, as the drive signals, ejection signals which permit ejection of the ink from the nozzles 35, non-ejection signals which change the volume of the pressure chambers 36 and vibrate the ink in the nozzles 35 but which do not permit ejection of the ink from the nozzles 35, and ejection-free signals which do not change the volume of the pressure chambers and which do not permit the ejection of the ink from the nozzles 35. The ejection signals are generated based on the signals FIRE1-FIRE3. The non-ejection signals are generated by the signal non-FIRE. The ejection-free signals are generated by the signal VDD1. In detail, where the ejection signals are applied to arbitrary pressure-generating portions of the actuator unit 20, the pressure-generating portions in question initially deform so as to increase the volume of the corresponding pressure chambers 36, namely, the pressure-generating portions which have been kept deformed convexly toward the pressure chambers 36 deform so as to be in a state in which the pressure-generating portions undergo no strain, thereby producing a negative pressure wave in the channel unit 10. At a timing when the pressure wave reflects on a side wall of each of the recessed portions 36*b* connected to the respective pressure chambers 36 and thereby returns as a positive pressure wave traveling toward the corresponding nozzles 35, the pressure-generating portions deform so as to decrease the volume of the pressure chambers 36, namely, the pressure-generating portions again deform convexly toward the pressure chambers 36, whereby the ink is ejected from the corresponding nozzles 35. This technique is a so-called "fill-before-fire" method which gives the ink a large pressure by superposing the positive pressure wave reflected as described above and a positive pressure wave produced by deformation of the actuator unit 20. Meanwhile, where the non-ejections signals are applied to arbitrary pressure-generating portions of the actuator unit 20, the pressure-generating portions in question deform so as to decrease the volume of the corresponding pressure chambers 36 before or after the negative pressure wave produced as described above reflects and returns as the positive pressure wave, namely, at a timing different from the positive pressure wave. In this instance, the actuator unit 20 deforms whereas the ink is not ejected from the nozzles 35. Where the ejection-free signals are applied, the pressure-generating portions of the actuator unit 20 are always kept deformed convexly toward the pressure chambers 36, so that the volume of the pressure chambers 36 is not changed.

The non-ejection signals has a frequency which is set to be higher than that of the ejection signals and which is set to be equal to a resonance frequency of the actuator unit 20.

The driver IC 103 further includes a temperature sensor 181 for detecting an environmental temperature, a check circuit 182, and a switch circuit 183. The switch circuit 183 is arranged to output one of an output (A) from the temperature sensor 181 and an output (B) from the check circuit 182.

The check circuit 182 detects whether or not the waveform signals FIREm (wherein m represents an integer of 1-3) and non-FIRE, serial signals SIN-n (wherein n represents 0 or 1) of the selection data, the transfer clock CLK, and the strobe signal STB which are outputted from the waveform-signal generating portion 110 are normally inputted, namely, whether or not the control portion 101 and the driver IC 103 are connected to each other. The confirmation, by the check circuit 182, as to whether the control portion 101 and the driver IC 103 are connected is made only once at a production stage of the ink-jet printer 100.

Described more specifically, at the production stage of the ink-jet printer 100, the control portion 101 outputs, to the switch circuit 183, a high-level switch signal nV-C until the confirmation of the connection between the control portion 101 and the driver IC 103 is made and a low-level switch signal nV-C after the confirmation of the connection has been made. The switch circuit 183 outputs, to the control portion 101 via a signal line of VTEMP-CHEK, a signal from the check circuit 182 while the high-level switch signal nV-C is inputted thereto and a signal from the temperature sensor 181 while the low-level switch signal nV-C is inputted thereto.

Accordingly, at a stage of use of the ink-jet printer 100, the signal from the temperature sensor 181 is outputted to the control portion 101, in detail, to the CPU 115. It is noted that the driver IC 103 is fixed to one surface of the channel unit 10 made of the metal material, such that the driver IC 103 is positioned to be adjacent to the actuator unit 20 as shown in FIG. 3. In this respect, the temperature detected by the temperature sensor 181 is substantially equal to the environmental temperature of the actuator unit 20.

As shown in FIG. 9, the control portion 101 includes a temperature storage portion 120 which stores mutually different three temperature values, e.g., 20° C., 40° C., and 100° C. Upon receiving of the signal from the temperature sensor 181 of the driver IC 103, the CPU 115 refers to the temperature storage portion 120 and judges whether the temperature detected by the temperature sensor 181 is not higher than the lowest temperature value (20° C.) as a first temperature, not lower than the medium temperature value (40° C.) as a second temperature, and not lower than the highest temperature value (100° C.).

Where the CPU 115 judges that the temperature detected by the temperature sensor 108 is not higher than the lowest temperature value 20° C. as the first temperature (and it is accordingly presumed that the environmental temperature of the actuator unit 20 is substantially not higher than 20° C.), the control portion 101 executes a low-temperature-condition control. That is, the CPU 115 controls the main circuit 102 such that the drive buffer 172 of the driver IC 103 produces the non-ejection signals. The produced non-ejection signals are applied to the respective pressure-generating portions of the actuator unit 20, so that the actuator unit 20 is driven and accordingly generates heat. Further, the heat of the driver IC 103 generated as a result of production of the drive signals is transmitted to the actuator unit 20 via the channel unit 10 made of the metal material having good heat conductivity. Therefore, the environmental temperature of the actuator unit 20 rises with high efficiency owing to the synergistic effect of the heat generated by the actuator unit 20 per se and the heat transmitted to the actuator unit 20 from the driver IC 103.

The control of the CPU 115 described above (the low-temperature-condition control) is executed not only when the recording sheet 62 is located at a position at which the sheet 62 can be opposed to the ink ejection surface of each ink-jet head 6, but also before the recording sheet 62 is fed to that position. Namely, in a case where a plurality of the recording sheets 62 are successively fed, the judging of the temperature described above is performed before each recording sheet 62 is fed to the position at which the sheet 62 can be opposed to the ink ejection surface of each ink-jet head 6. If the temperature detected by the temperature sensor 108 is judged to be not higher than the prescribed lowest temperature value (the first temperature) before each sheet 62 reaches the above-indicated position, the actuator unit 20 is arranged to be driven as soon as the judgment is made.

Where the CPU 115 judges that the temperature detected by the temperature sensor 181 is not lower than the medium temperature value 40° C. as a second temperature (and it is accordingly presumed that the environmental temperature of the actuator unit 20 is substantially not lower than 40° C.), the control portion 101 executes a high-temperature-condition control. That is, the CPU 115 outputs a signal to the Peltier element 104. Upon receiving of the signal from the CPU 115, the Peltier element 104 works, thereby cooling the actuator unit 20.

Where the CPU 115 judges that the temperature detected by the temperature sensor 181 is not lower than the highest temperature value 100° C., the CPU 115 adjusts a time period during which the printing operation is not performed, whereby the driver IC 103 is prevented from being damaged or broken by heat.

In the present ink-jet printer 100 constructed as described above, the environmental temperature of the actuator unit 20 can be kept equal to or higher than the suitable value (20° C. in the illustrated embodiment). Therefore, it is possible to avoid deterioration of the print quality which arises from the change in the deformation amount of the actuator unit 20 due to the environmental temperature. Moreover, it is not necessary, for avoiding the deterioration of the print quality, to vary the waveform and the voltage of the drive signals to be applied to the actuator unit 20, depending upon the environmental temperature of the same 20. Accordingly, the structure of the control portion 101 is simplified.

In the ink-jet printer 100 constructed as described above, it is possible to detect, by utilizing the temperature sensor 181 of the driver IC 103, the substantial environmental temperature of the actuator unit 20 without an additional temperature sensor used exclusively for detecting the environmental temperature of the actuator unit 20 while, at the same time, the environmental temperature of the actuator unit 20 can be raised without additionally providing the actuator unit 20 with any heating device such as a heater. Therefore, the number of the required components can be reduced, resulting in a simplified structure and a reduced cost of manufacture of the actuator unit 20, and accordingly of the ink-jet printer 100.

In the present ink-jet printer 100, the actuator unit 20 is fixed to the channel unit 10 formed of the metal material having good heat conductivity, and therefore the heat of the actuator unit 20 is dissipated via the channel unit 10. Accordingly, the environmental temperature of the actuator unit 20 is prevented from being increased to an excessive degree.

The deformation characteristic of the piezoelectric actuator is stabilized by keeping the environmental temperature of the actuator unit 20 within the prescribed range, e.g., in the range from not lower than 20° C. to not higher than 40° C. in the illustrated embodiment, whereby the print quality can be improved. In addition, in the illustrated embodiment, the temperature of the ink in the individual ink channels formed in the channel unit 10 is prevented from being largely changed in accordance with the change in the environmental temperature of the actuator unit 20, so that the temperature of the ink is stabilized, contributing to the improvement of the print quality. More specifically described, the viscosity of the ink changes depending upon the temperature of the channels, and the change in the viscosity influences the ink ejection characteristic. In this respect, the temperature of the ink can be stabilized as mentioned above, so that good ink ejection characteristic is maintained, resulting in the improvement in the print quality.

Where the CPU 115 judges that the temperature detected by the temperature sensor 181 is not higher than the prescribed value, i.e., 20° C., the CPU 115 controls the main circuit 102 such that the drive buffer 172 of the driver IC 103 produces the non-ejection signals. The non-ejection signals applied to the actuator unit 20 do not permit ejection of the ink from the nozzles 35. Therefore, the environmental temperature of the actuator unit 20 can be raised while avoiding the problem that the recording sheets 62, the platen roller 66, etc., are stained with the ink.

In the illustrated embodiment, the frequency of the non-ejection signals is set to be higher than that of the ejection signals. Because the heat generation amount of the driver IC 103 is proportional to frequency, the heat generation amount of the driver IC 103 is increased by production of the drive signals with a higher frequency. Accordingly, the environmental temperature of the actuator unit 20 can be raised with high efficiency.

In the illustrated embodiment, the frequency of the non-ejection signals is set to be equal to the resonance frequency of the actuator unit 20. Accordingly, the drive signals whose frequency is equal to the resonance frequency of the actuator unit 20 are produced, thereby permitting the driver IC 103 to generate heat with the highest efficiency. Thus, the environmental temperature of the actuator unit 20 can be effectively raised.

The present ink-jet printer 100 includes the Peltier element 104 for cooling the actuator unit 20, and the CPU 115 controls the Peltier element 104 to cool the actuator unit 20 where the temperature detected by the temperature sensor 181 is judged to be not lower than the second temperature (the medium temperature 40° C. in the present embodiment). According to this arrangement, there are set, for the environmental temperature of the actuator unit 20, the upper limit (40° C.) as well as the lower limit (20° C.), whereby the environmental temperature of the actuator unit 20 can be held within the prescribed range, e.g., in the range from not lower than 20° C. to not higher than 40° C. in the illustrated embodiment. Therefore, the deterioration of the print quality can be effectively prevented.

In the illustrated embodiment, the actuator unit 20 can be efficiently cooled by using the Peltier element 104 which is small in size and light in weight and which operates in a quiet manner.

In the illustrated embodiment, before the recording sheet 62 reaches the position at which the sheet 62 can face each ink-jet head 6, the environmental temperature of the actuator unit 20 can be raised by driving the same 20. According to this arrangement, the temperature of the channel unit 10 to which the actuator unit 20 is fixed is raised, thereby lowering the viscosity of the ink in the channel unit 10. As a result, the printing operation can be appropriately performed on the recording sheet 62 starting form its leading end. Further, even when the ink is ejected from the nozzles 35 by deformation of the actuator unit 20 as a result of application of the drive signals thereto, the recording sheet 62 is yet to reach the position at which the sheet 62 can be opposed to the ink ejection surface of each ink-jet head 6. Because the recording sheet 62 is not present at the position, it is possible to avoid a problem of staining of the sheet 62 with the ink.

Figure 12:
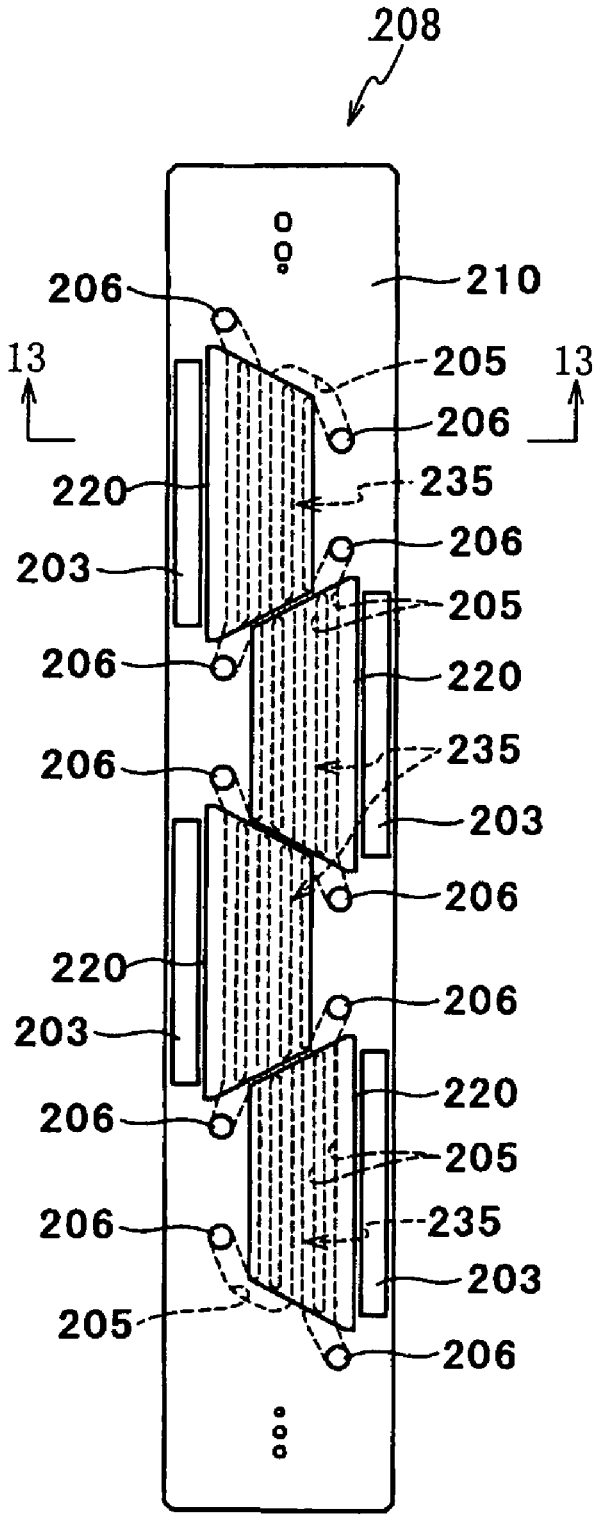
FIG. 12 is a plan view of an ink-jet head according to a modified embodiment of the present invention.
Figure 13:
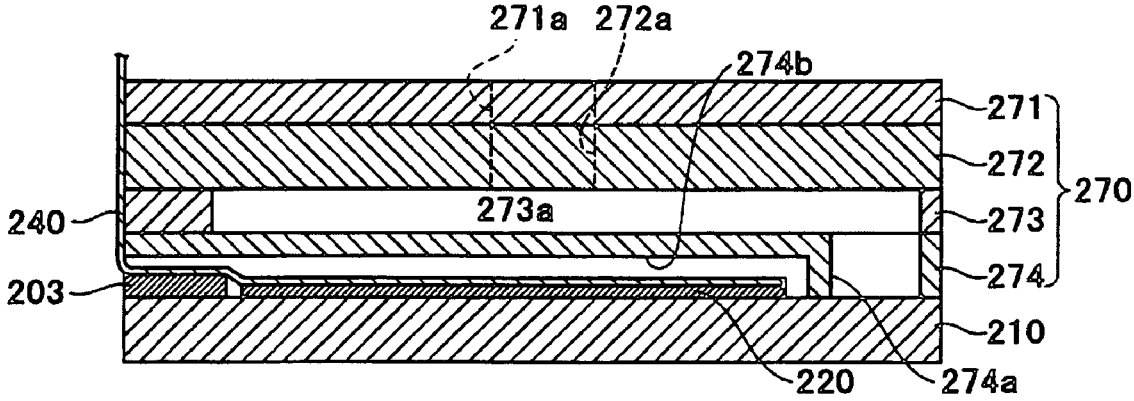
FIG. 13 is a cross sectional view taken along line 13-13 of FIG. 12.

FIGS. 12 and 13 show an ink-jet head according to a modified embodiment of the present invention. As shown in FIGS. 12 and 13, the ink-jet head 208 includes a channel unit 210 having a generally rectangular parallelepiped shape, four trapezoidal actuator units 20 fixed to an upper surface of the channel unit 210, and a reservoir unit 270 which is fixed to portions of the upper surface of the channel unit 210 except portions to which the actuator units 20 are fixed, as shown in FIG. 13. In this modified embodiment, there are provided four driver ICs 203 for the respective four actuator units 220. In detail, each of the driver ICs 203 is fixed to the upper surface of the channel unit 210 so as to be adjacent to a lower side of a corresponding one of the trapezoidal actuator units 220.

In the ink-jet head 208, there are provided four flexible flat cables 240 so as to correspond to the respective four actuator units 220 and the respective four driver ICs 203. As shown in FIG. 13, each of the flexible flat cables 240 is fixed to upper surfaces of the corresponding actuator unit 220 and driver IC 203 and drawn out from a corresponding one of four recessed portions 274*b* formed in an under plate 274 of the reservoir unit 270 which will be described, along a corresponding one of two mutually opposed side surfaces of the reservoir unit 270.

The reservoir unit 270 has a stacked structure in which four plates, i.e., an upper plate 271, a filter plate 272, a reservoir plate 273, and the under plate 274 are stacked on each other. The reservoir plate 273 has four ink reservoirs 273*a* formed through the thickness thereof for storing the respective inks. The upper plate 271 and the filter plate 272 respectively have through-holes 271*a* and through-holes 272*a* communicating with the corresponding ink reservoir 273*a*. The under plate 274 has the above-indicated four recessed portions 274*b* formed in its lower surface by half-etching or the like. Each recessed portion 274*b* defines a space in which the corresponding actuator unit 220 and driver IC 203 are accommodated. The under plate 274 has communication holes 274*a* formed through the thickness of the plate 274 at portions thereof except regions where the recessed portions 274*b* are formed. The communication holes 274*a* of the under plate 274 communicate with respective ink supply inlets 206 formed in the upper surface of the channel unit 210.

The ink introduced from an ink supply source such as an ink tank not shown, into the corresponding through-hole 271*a* flows into the corresponding ink reservoir 273*a* via the corresponding through-hole 272*a*, and temporarily stored therein. Subsequently, the ink is supplied to the channel unit 210 via the corresponding communication hole 274*a*. The ink supplied to the inside of the channel unit 210 through the ink supply inlets 206 reaches the pressure chambers not shown, via manifolds 205 and is finally ejected from the nozzles 235.

In this modified embodiment, the driver ICs 203 having respective temperature sensors are disposed adjacent to the respective actuator units 220, whereby the environmental temperature can be controlled for the individual actuator units 220. Accordingly, where the environmental temperature of only some of the four actuator units 220 rises or lowers and accordingly is outside the prescribed range, the environmental temperature of only those actuator units 220 that has risen or lowered can be controlled to lower or rise, thereby keeping the environmental temperature of all of the actuator units 220 appropriately. Consequently, the record quality can be improved.

While the preferred embodiments of the present invention have been described in detail by reference to the drawings, it is to be understood that the present invention may be otherwise embodied.

Figure 14:
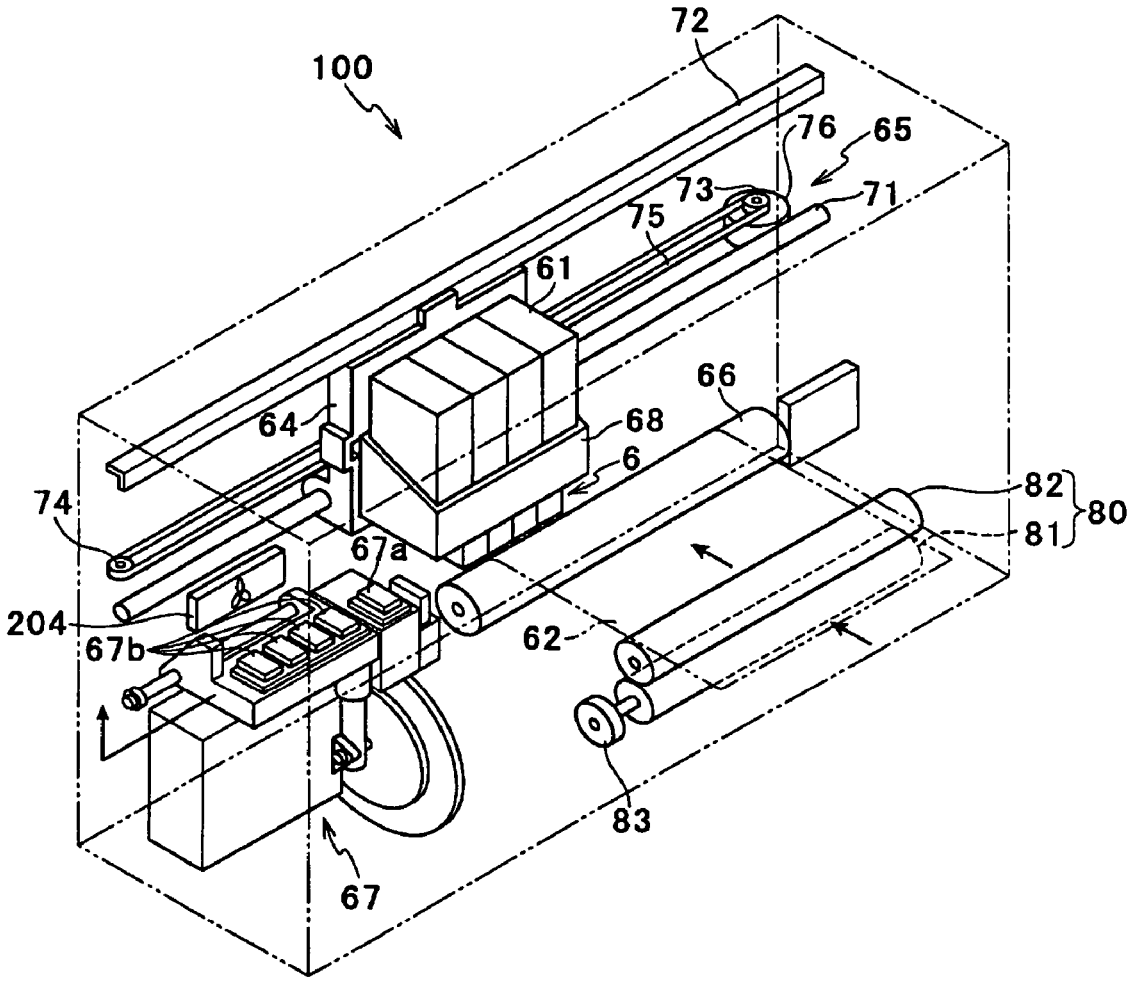
FIG. 14 is a perspective view of an ink-jet printer equipped with an air-cooling fan as a cooling device.

The actuator unit 20 may be cooled by an air-cooling fan 204 shown in FIG. 14, in place of the Peltier element 104. The air-cooling fan 204 is disposed at a location above the purge mechanism 57 and in the vicinity of the retracted position of the carriage 64. The location of the air-cooling fan 204 is not particularly limited, but may be in the vicinity of the platen roller 66. The air-cooling fan 204 is relatively inexpensive, leading to a reduced cost for the ink-jet printer 100.

Both of the Peltier element 104 and the air-cooling fan 204 may be eliminated. In this instance, the actuator unit 20 may be cooled by causing an air flow relative to the same 20 as a result of moving of the ink-jet head 6 by the carriage moving mechanism 65. This arrangement does not require any additional member for cooling the actuator unit 20 such as the air-cooling fan 204, resulting in a further reduced cost for the ink-jet printer 100.

It is not necessary for the ink-jet printer 100 to have the cooling device for cooling the actuator unit 20, such as the Peltier element 104, the air-cooling fan 204 or the carriage moving mechanism 65.

The frequency of the non-ejection signals to be outputted from the drive buffer 172 may not be higher than the frequency of the ejection signals also outputted from the drive buffer 172 and may not be equal to the resonance frequency of the actuator unit 20. Moreover, the non-ejection signals may be otherwise arranged, provided that the non-ejection signals are arranged to inhibit the ink from being ejected from the nozzles 35.

The main circuit 102 may be arranged such that the CPU 115 controls the drive buffer 172 of the driver IC 103 to produce the ejection signals in place of the non-ejection signals, where the CPU 115 judges that temperature detected by the temperature sensor 181 is not higher than the prescribed value. In this case, although the ink is ejected from the nozzles 35, the recording sheet 62 is prevented from being stained with the ink if the control by the CPU 115 for permitting the drive buffer 172 to produce the ejection signals as described above is arranged to be executed only before the recording sheet 62 is fed to the location at which the sheet 62 can be opposed to the ink ejection surface of each ink-jet head 6. Alternatively, the above-mentioned control by the CPU 115 may be executed only when the carriage 64 is located at the retracted position, thereby avoiding the problem of staining of the sheet 62, the platen roller 66, etc., with the ink.

The prescribed temperature-related values that are stored in the temperature storage portion 120 are not limited to the above-indicated values, i.e., 20° C., 40° C., and 100° C., but may be any suitable values. Further, the number of the values stored in the temperature storage portion 120 is not limited to three, but may be one, two, or four or more. In the present invention, at least one temperature-related value is set and the environmental temperature of the actuator unit is raised by driving the actuator unit where the temperature detected by the temperature sensor of the driver IC is judged to be not higher than one of the at least one temperature-related value. Accordingly, the control portion 101 may not execute the above-mentioned high-temperature-condition control wherein the actuator unit is cooled where the temperature detected by the temperature sensor becomes not lower than a prescribed value (40° C.). Further, the control portion 101 may not execute the above-mentioned control of adjusting of the time period during which the printing operation is not performed for preventing damage of the driver IC due to heat where the temperature detected by the temperature sensor becomes not lower than another prescribed value (100° C.) which is higher than the above-indicated prescribed value (40° C.).

The ink-jet recording apparatus according to the present invention is not limited to the serial-type printer illustrated above, but may be applied to a line-type printer. The principle of the present invention is applicable not only to the ink-jet printer, but also to a facsimile machine and other devices equipped with the ink-jet heads.

It is to be understood that the present invention may be embodied with various other changes and modifications, which may occur to those skilled in the art, without departing from the spirit and scope of the invention defined in the appended claims.

What is claimed is:

1. An ink-jet recording apparatus comprising: an ink-jet head which includes:

a channel unit having a plurality of nozzles and a plurality of pressure chambers that respectively communicate with the plurality of nozzles;

a reservoir unit formed of a plurality of plates which are stacked on each other and disposed on the channel unit for supplying ink thereto, the reservoir unit having a recessed portion being formed in a lower surface of a lowermost one of the plurality of plates of the reservoir unit; and an actuator unit which is disposed on the channel unit and to which drive signals are applied, thereby changing a volume of the plurality of pressure chambers;

a driver IC comprising a temperature sensor for detecting an environmental temperature of the actuator unit, and which includes a drive-signal generating portion for generating the drive signals to change the volume of the plurality of pressure chambers and for applying the generated drive signals to the actuator unit, the drive signals comprising ejection signals and non-ejection signals, each of the ejection signals for driving the actuator unit to eject ink from the plurality of nozzles and comprising at least one pulse, each of the non-ejection signals for driving the actuator unit without ejecting ink from the plurality of nozzles and comprising at least one pulse; and a control device arranged to execute a low-temperature-condition control by controlling the drive-signal generating portion to generate the non-ejection signals, where the environmental temperature detected by the temperature sensor is not higher than a prescribed first temperature, wherein the driver IC is disposed on the channel unit so as to be located adjacent to the actuator unit, and the actuator unit and the driver IC are accommodated in the recessed portion of the reservoir unit.

2. The ink-jet recording apparatus according to claim 1, wherein the channel unit is formed of metal material.

3. The ink-jet recording apparatus according to claim 1, wherein the non-ejection signals have a frequency higher than that of the ejection signals.

4. The ink-jet recording apparatus according to claim 3, wherein the frequency of the non-ejection signals is equal to a resonance frequency of the actuator unit.

5. The ink-jet recording apparatus according to claim 1, wherein the ink-jet head includes a plurality of actuator units each as the actuator unit and the ink-jet recording apparatus includes a plurality of driver ICs each as the driver IC which are provided respectively for the plurality of actuator units, and wherein the control device executes the low-temperature-condition control individually on the plurality of actuator units on the basis of the respective environmental temperatures of the plurality of actuator units measured by the respective temperature sensors of the plurality of driver ICs.

6. The ink-jet recording apparatus according to claim 1, wherein the low-temperature-condition control is executed when the ink-jet head is not opposed to a recording medium.

7. The ink-jet recording apparatus according to claim 6, further comprising a recording-medium feeding device which feeds the recording medium, wherein the low-temperature-condition control is executed before the recording medium is fed by the recording-medium feeding device to a position at which the recording medium can be opposed to the ink-jet head.

8. The ink-jet recording apparatus according to claim 6, further comprising a carriage holding the ink-jet head and a carriage moving device which moves the carriage, wherein the low-temperature-condition control is executed when the carriage is placed, by the carriage moving device, at a retracted position where the ink-jet head cannot perform a recording operation on the recording medium.

9. The ink-jet recording apparatus according to claim 1, further comprising a cooling device which cools the actuator unit, wherein the control device is arranged to execute a high-temperature-condition control by controlling the cooling device to cool the actuator unit, where the environmental temperature detected by the temperature sensor is not lower than a prescribed second temperature that is set to be higher than the prescribed first temperature.

10. The ink-jet recording apparatus according to claim 9, wherein the cooling device is constituted by including an air-cooling fan.

11. The ink-jet recording apparatus according to claim 9, further comprising a head moving device which moves the ink-jet head, wherein the head moving device functions as the cooling device by moving the ink-jet head so as to cause an air flow relative to the actuator in air contacting the actuator unit.

12. The ink-jet recording head according to claim 9, wherein the cooling device is constituted by including a Peltier element.

* * * * *